US010682687B2

(12) United States Patent
Guerard et al.

(10) Patent No.: US 10,682,687 B2
(45) Date of Patent: Jun. 16, 2020

(54) TURBOMACHINE BLADE COOLING CIRCUIT

(71) Applicant: SAFRAN AIRCRAFT ENGINES, Paris (FR)

(72) Inventors: Coralie Cinthia Guerard, Colombes (FR); Vincent Marc Herb, Alfortville (FR); Jun Ni, Boulogne Billancourt (FR); Joseph Toussaint Tami Lizuzu, Gonesse (FR); Matthieu Jean Luc Vollebregt, Asnieres sur Seine (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/314,341

(22) PCT Filed: Jun. 7, 2017

(86) PCT No.: PCT/FR2017/051438
§ 371 (c)(1),
(2) Date: Dec. 28, 2018

(87) PCT Pub. No.: WO2018/002466
PCT Pub. Date: Jan. 4, 2018

(65) Prior Publication Data

US 2019/0240725 A1 Aug. 8, 2019

(30) Foreign Application Priority Data

Jun. 28, 2016 (FR) ..... 16 56042

(51) Int. Cl.
*B22C 9/10* (2006.01)
*B22C 9/24* (2006.01)
(Continued)

(52) U.S. Cl.
CPC ..... *B22C 9/10* (2013.01); *B22C 9/04* (2013.01); *B22C 9/24* (2013.01); *F01D 5/187* (2013.01); *F05D 2250/241* (2013.01)

(58) Field of Classification Search
CPC .. B22C 9/00; B22C 9/04; B22C 9/043; B22C 9/10; B22C 9/24; B22C 13/00; B22C 13/08; B22C 13/085; B22C 13/12
See application file for complete search history.

(56) References Cited

U.S. PATENT DOCUMENTS 7,758,314 B2 * 7/2010 Wilson ..... F01D 5/28 416/226
2013/0280092 A1 10/2013 Xu

FOREIGN PATENT DOCUMENTS

EP 0 258 754 A2 3/1988
EP 1 598 523 A1 11/2005
EP 1 775 420 A2 4/2007

OTHER PUBLICATIONS

International Search Report dated Sep. 27, 2017, issued in corresponding International Application No. PCT/FR2017/051438, filed Jun. 7, 2017, 13 pages.

* cited by examiner

*Primary Examiner* — Kevin P Kerns
*Assistant Examiner* — Steven S Ha
(74) *Attorney, Agent, or Firm* — Christensen O'Connor Johnson Kindness PLLC

(57) ABSTRACT

The present disclosure is generally directed to a core configured for the manufacturing of a turbine engine blade by lost-wax casting. The core includes a first convex curved outer face and a second concave curved outer face. The first and second faces have a plurality of recesses, each recess including a spherical portion.

11 Claims, 4 Drawing Sheets

(51) Int. Cl.

| | |
|---|---|
| ***F01D 5/18*** | (2006.01) |
| ***B22C 9/04*** | (2006.01) |

TURBOMACHINE BLADE COOLING CIRCUIT

TECHNICAL FIELD

The present invention relates to the manufacturing of a turbine engine blade by lost-wax casting, and more specifically a blade comprising an inner cooling cavity.

STATE OF THE ART

The mobile blades of a turbine engine turbine, such as a low pressure turbine or a high pressure turbine, each comprise an inner cooling circuit which makes it possible for them to withstand the thermal stress to which the blades are subject when the turbine engine is in operating mode. A flow of cooling air circulates through the inner cooling circuit.

A cooling circuit comprises, for example, at least one inlet opening located in the vicinity of the blade root, at least one inner cavity and at least one outlet opening located in the vicinity of the top of the blade, the flow of air circulating successively through the inlet opening, the cavity and then the outlet opening.

In order to maximise the thermal exchange between the flow of air and the blade, in other words the cooling of the blade, the cavity conventionally comprises disruptors which are, for example, in the form of fins or concave shapes. The disruptors must enable to homogeneously distribute the air flow throughout the entire blade without slowing it down. In this document, a particular interest is paid to small blades that, owing to the size thereof, have small cavities. It has been noted that the geometric and dimensional characteristics selected for the disruptors of large blades are not applicable to small blades.

A blade is, for example, manufactured by lost-wax casting. According to this manufacturing technique, a wax model is moulded in a mould in which is placed a core (also called a foundry core), which is created beforehand. The wax model is then covered, in an alternating manner, by ceramic slip and a refractory powder so as to create a shell. The wax is subsequently chased from the shell and the shell is heated at a high temperature. The molten metal is then poured into the shell, the metal thereby specifically occupying the empty space between the core and the inner face of the shell. After solidification of the metal, the blade is obtained by removing the shell and the core.

The core is, for example, made of a ceramic material with a porous structure. The core is generally obtained in an injection moulding press.

If the cavity of the blade comprises fins, the core has a complex form and comprises, in particular, thin voids that are configured to form fins after the pouring of the molten metal.

The complexity of the core requires the use of a mould (also called a core box) comprising a plurality of sub-parts that are mobile with respect to one another, this architecture preventing undercuts, in other words allowing the proper removal of the mould from the core.

However, such a mould is not compatible with blade geometries, which is the case, for example, for a blade locally presenting, in a transversal plane, a high degree of curvature.

Furthermore, owing to the difficulty of positioning these various sub-parts with respect to one another, it has been noted that the required geometric and dimensional characteristics of the fins are not achievable, in other words the impossibility of this manufacturing method does not enable to obtain the required cooling performance of the blade.

Furthermore, during the core injection process, filling is achieved by mould flow, this filling process being likely to cause the appearance of defects, and more globally, to lead to the scrapping of a significant number of cores.

An alternative could be to create the voids in a subsequent machining step, which would be detrimental to productivity (core machining process taking a long time).

In the case where the inner walls of the cavity comprise concave shapes, the shape of the core is simpler, thus facilitating the manufacturing thereof.

However, the cooling of the blade is not satisfactory. Indeed, the presence of concave shapes generates swirls inside the cavity, these swirls negatively affecting the flow of air. Furthermore, the concave shapes do not enable to distribute the flow of air homogeneously throughout the blade, in other words the flow of air does not sufficiently cool the blade.

The prior art also comprises documents US-A1-2013/280092, EP-A2-0258754, EP-A2-1775420 and EP-A1-1598523.

The purpose of the present invention is to propose a blade with an adequate cooling circuit, while optimising the manufacturing method thereof.

DESCRIPTION OF THE INVENTION

For this purpose, the invention proposes a core configured for the manufacturing of a turbine engine blade by lost-wax casting, the core comprising a first convex curved outer face and a second concave curved outer face, characterised in that the first and second faces comprise a plurality of recesses, each recess comprising a spherical portion, wherein each said recess is defined at least partially by an axis of symmetry, the axes of symmetry of the spherical portions of the first face being parallel to a first direction, wherein said first direction is defined, in a transversal plane, by the bisector of the angle formed by the intersection of a first tangent to the first face at the first point of junction between the first face and a first connection between the first and second faces, and a second tangent to the first face at the second point of junction between the first face and a second connection between the first and second faces, the first and second tangents being defined in the transversal plane, and the first and second points of junction being opposite one another.

The structure of the core is simple and thus makes it possible to minimise the number of scrapped cores. This type of core further avoids a filling by mould flow.

The core according to the invention can comprise one or more of the following characteristics, taken individually or in combination:

- the recesses of the first face are offset with respect to the recesses of the second face;
- the transversal plane is substantially perpendicular to an elongation axis of the core, or not;
- the axes of symmetry of the spherical portions of the second face are parallel to a second direction;
- the second direction is defined, in a transversal plane, by the bisector of the angle formed by the intersection of a first tangent to the second face at the third point of junction between the second face and the first connection, and a second tangent to the second face at the fourth point of junction between the second face and the second connection, the first and second tangents being defined in the transversal plane, and the third and fourth points of junction being opposite one another.

A second purpose of the invention is to propose a mould configured for the manufacturing of a core such as described above, the mould comprising a first imprint and a second imprint that are mobile with respect to one another and delimiting an injection cavity of the core, the first imprint comprising a first concave curved inner surface configured to form the first face of the core, the second imprint comprising a second convex curved inner surface configured to form the second face of the core, the first and second surfaces comprising a plurality of protrusions configured to form the recesses of the core, each protrusion comprising a spherical part, wherein each protrusion is at least partially defined by an axis of symmetry, the axes of symmetry of the spherical parts of the first surface being parallel to said first direction of said core, said first direction corresponding to a first mould-release direction.

The structure of the mould is simple in that it has a first imprint and a second imprint that are easy to position with respect to one another. This structure considerably reduces the number of scrapped cores. This cooling circuit is furthermore compatible with various blade geometries, and in particular with blades that have, locally in a transversal plane, a high degree of curvature.

The mould according to the invention can comprise one or more of the following characteristics, taken individually or in combination:

- the axes of symmetry of the spherical portions of the protrusions of the second surface are parallel to said direction of said core, said second direction corresponding to a second mould-release direction;
- the first imprint is mobile along the first mould-release direction and/or the second imprint is mobile along the second mould-release direction;
- each boss is defined by an axis of symmetry, the axes of symmetry of the spherical sections of the bosses of the first wall being parallel.

A third purpose of the invention relates to a manufacturing method of a turbine engine blade by lost-wax casting, this method comprising a step wherein a core such as described above is manufactured in a mould such as described above, the method preferably comprising a mould-release step wherein the first imprint is moved along a first mould-release direction and/or the second imprint is moved along a second mould-release direction.

The manufacturing method of the blade is simplified, and in particular that of the core, which increases productivity.

A fourth purpose of the invention relates to a blade obtained by the manufacturing method described above, the blade comprising a cooling cavity delimited by a first concave curved inner wall and by a second convex curved inner wall, the first and second walls each comprising a plurality of bosses, each boss comprising a spherical section.

The cooling cavity enables the homogeneous distribution of the flow of cooling air on the first and second walls without slowing down the blade, in other words, generally, it allows for the efficient cooling of the blade.

The blade according to the invention can comprise one or more of the following characteristics, taken individually or in combination:

- the bosses of the first wall are offset with respect to the bosses of the second wall;
- the axes of symmetry of the spherical sections of the bosses of the first wall are parallel;
- the axes of symmetry of the spherical sections of the bosses of the second wall are parallel;

DESCRIPTION OF THE FIGURES

The invention will be better understood, and other details, characteristics and advantages of this invention will become clearer upon reading the following description, provided as an example and not limited thereto, and with reference to the appended drawings, wherein.

DETAILED DESCRIPTION

Figure 1:
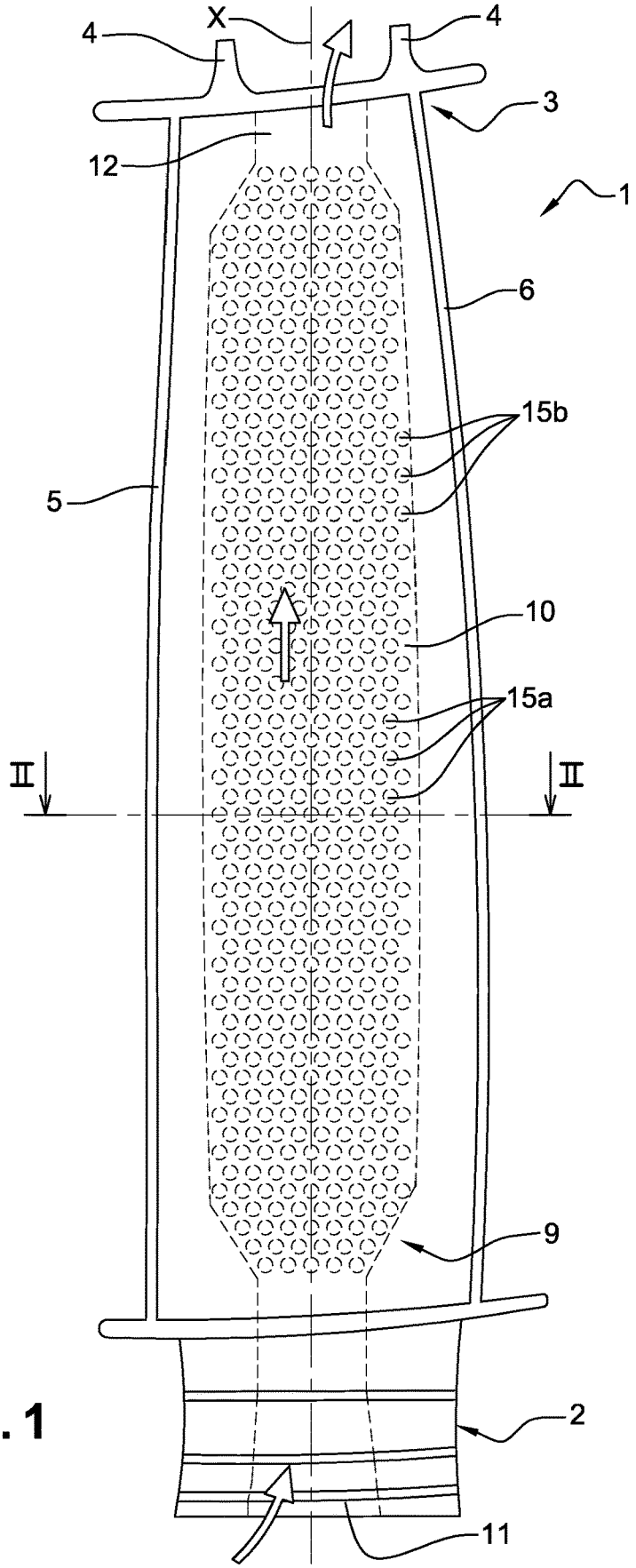
FIG. 1 is a schematic front view of a blade.

In FIG. 1, a blade 1 of a turbine engine turbine is shown, for example of a high pressure turbine or a low pressure turbine.

The blade 1 comprises a leading portion with an aerodynamic profile that extends longitudinally along an axis X between a root 2 of the blade 1 and a top 3 of the blade 1.

In this document, the term "longitudinally" or "longitudinal" describes any direction parallel to the axis X, and the term "transversally" or "transversal" describes a direction perpendicular to the axis X.

More specifically, the root 2 of the blade 1 is configured to be mounted on a rotor (not shown) of the turbine. The top 3 of the blade 1 comprises seals 4 arranged opposite an abradable coating mounted on a casing (not shown) of the turbine.

The leading portion with an aerodynamic profile of the blade 1 comprises a leading edge 5 arranged upstream in the direction of flow of the gases through the turbine, a trailing edge 6 opposite the leading edge 5, an upper side face 7, a lower side face 8, these upper and lower faces 7, 8 connecting the leading edge 5 to the trailing edge 6.

Figure 2:
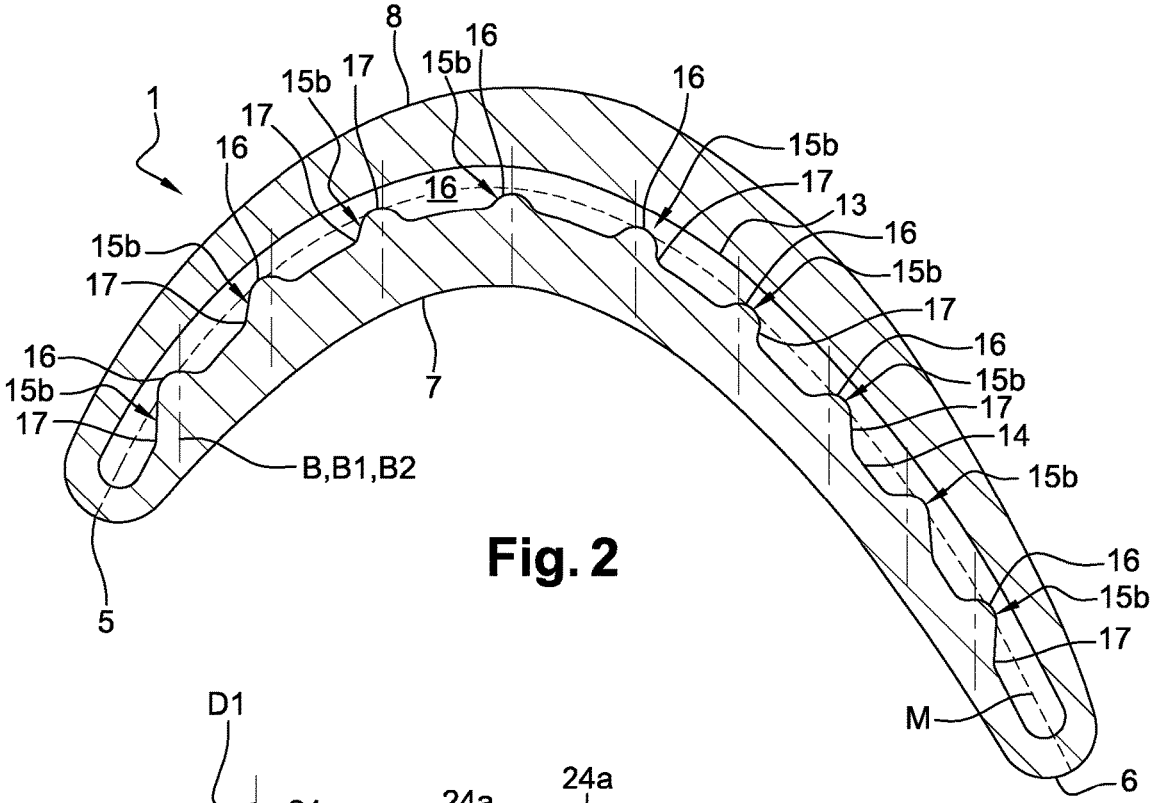
FIG. 2 is a section view of the blade shown in FIG. 1, according to the II-II plane of FIG. 1.

More specifically, according to the embodiment shown in FIG. 2, in a transversal plane, the blade 1 is profiled along a median line M connecting the leading edge 5 to the trailing edge 6. The upper and lower faces 7, 8 are curved, and respectively concave and convex. The blade 1 locally has a high degree of curvature.

The blade 1 further comprises an inner cooling circuit 9 that enables it to withstand the thermal stress to which it is subject, this cooling circuit 9 comprising at least one cooling cavity 10 that extends longitudinally between the root 2 of the blade 1 and the top 3 of the blade 1, at least one inlet opening 11, and at least one outlet opening 12. A flow of cooling air circulates through the inner cooling circuit 9.

According to the embodiment shown in the figures, and more specifically in FIG. 1, the inlet opening 11 is located in the root 2 of the blade 1 and opens onto the lower face of the root 2 of the blade 1, in the form, for example, of a plurality of channels. The outlet opening 12 is located at the level of the top 3 of the blade 1 and opens onto the upper face of the blade 1, in the form, for example, of a plurality of channels.

Such as shown by the arrows of FIG. 1, the cooling air flow circulates successively through the inlet opening 11, the cavity 10 and the outlet opening 12.

Such as shown in FIG. 2, the cooling cavity 10 is centred on the median line M of the blade 1 and is delimited by a first side wall 13 oriented on the lower side of the blade 1 and by a second side wall 14 oriented on the upper side of the blade 1. More specifically, the first and second walls 13, 14 are curved, and respectively concave and convex. The first and second walls 13, 14 comprise bosses 15*a*, 15*b* configured to orient the flow of air in the cavity 10, and more specifically to distribute it homogeneously on the first and second walls 13, 14 without slowing it down.

Advantageously, such as shown in FIG. 1, the bosses 15*a* of the first wall 13 are offset, longitudinally and transversally, with respect to the bosses 15*b* of the second wall 14.

Each boss 15*a*, 15*b* comprises a spherical section 16 and is defined at least partially according to an axis of symmetry B intersecting with the axis of symmetry B1 of the spherical section 16. The axes of symmetry B1 of the spherical sections 16 of the first wall 13 are parallel. Similarly, the axes of symmetry B1 of the spherical sections 16 of the second wall 14 are parallel.

Some bosses 15*a*, 15*b* further comprise a tapered section 17, which is more or less extended depending on the bosses 15*a*, 15*b*, of which the axis of symmetry B2 intersects with the axis of symmetry B of the bosses 15*a*, 15*b* and therefore with the axis of symmetry B1 of the spherical section 16.

Such as shown in FIG. 1, the bosses 15*a* are substantially arranged in a quincunx with respect to the bosses 15*b* in the leading portion, in a longitudinal projection plane perpendicular to the axis B. The blade 1 is manufactured by a lost-wax casting process, and the cooling cavity 10 of the blade 1 is therefore obtained by means of a core 18 shown in particular in FIG. 3, the latter being created in a mould 19 (also called core box) shown in FIG. 7. The cavity 10 of the blade 1, and therefore the production of the core 18, and in other words of the cavity 10, have dimensional and geometric characteristics that are identical to that of the core 18.

More specifically, the manufacturing method of the blade 1 comprises the following steps:

- a step whereby the core 18 is moulded (shown in FIG. 3) in the mould 19 (shown in FIG. 7);
- a moulding step of a wax model in a mould wherein the core 18 is placed;
- a step whereby a shell is made by covering the wax model, in an alternating manner, with ceramic slip and a refractory powder;
- a heating step wherein, simultaneously, the wax is chased from the shell and the shell is hardened, for example by steaming.
- a step whereby the molten metal is poured into the shell, the metal thereby specifically occupying the empty space between the core 18 and the inner face of the shell.
- a step whereby the shell and the core 18 are removed.

The cavity 10 of the cooling circuit 9 has the same geometric and dimensional characteristics as the core 18. The core 18 therefore comprises a first side face 20, a second side face 21, a first connection 22 defining a connection radius of the leading edge and a second connection 23 defining a connection radius of the trailing edge, the first and second faces 20, 21 connecting the first connection 22 and the second connection 23. The first and second faces 20, 21 of the core 18 comprise recesses 24*a*, 24*b* configured to form the bosses 15*a*, 15*b* of the cavity 10. The first and second faces 20, 21 of the core 18 are respectively configured to form the first wall 13 and the second wall 14 of the cavity 10.

Figure 3:
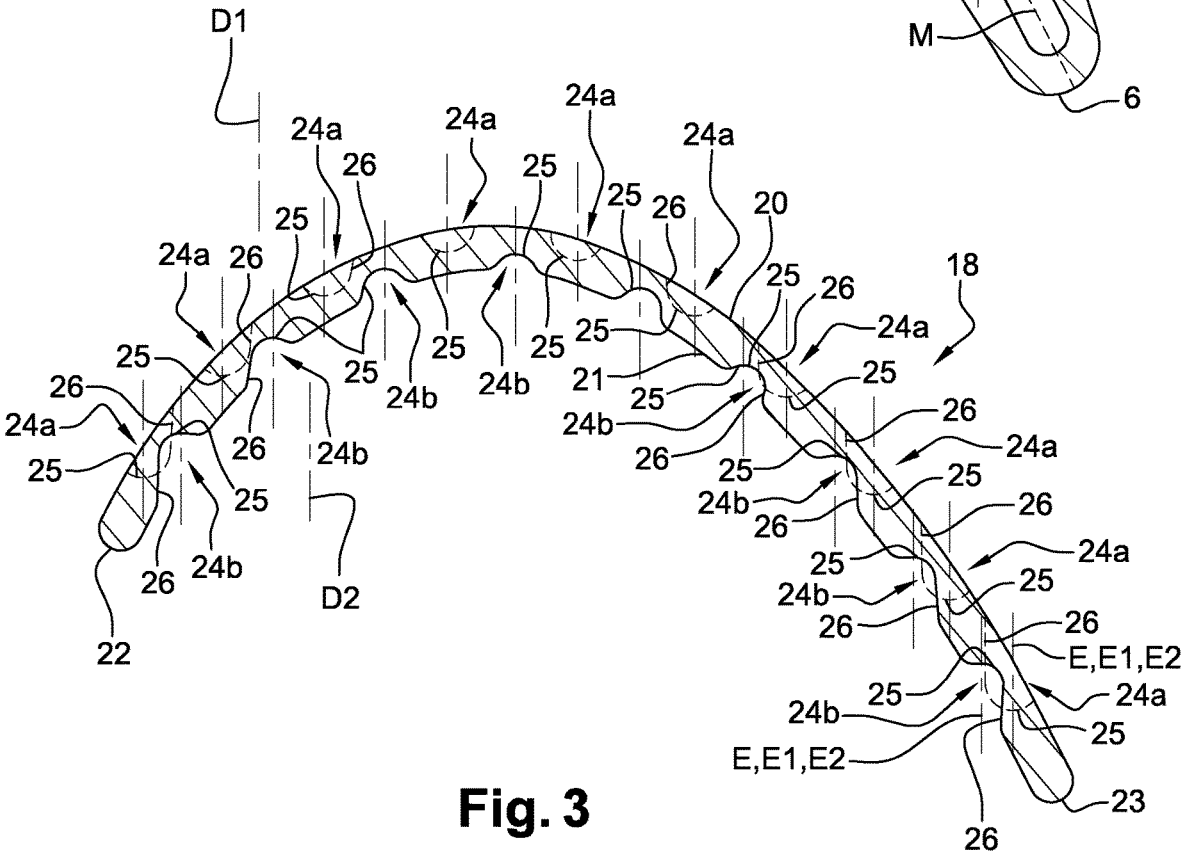
FIG. 3 is a transversal cross-sectional view of a core used for manufacturing a blade, at the level of a leading portion.

More specifically, such as shown in FIG. 3, the first and second faces 20, 21 are curved, and respectively convex and concave.

Each recess 24*a*, 24*b* comprises a spherical portion 25 and is defined at least partially according to an axis of symmetry E intersecting with the axis of symmetry E1 of the spherical portion 25. The axes of symmetry E1 of the spherical portions 25 of the first face 20 are parallel with a first direction D1. Similarly, the axes of symmetry E1 of the spherical portions 25 of the second face 21 are parallel with a second direction D2.

Depending on the selected first and second directions D1, D2 and the dimensional characteristics of the recesses 24*a*, 24*b* (radius of the tapered portion 26, depth of the recess 24*a*, 24*b*), some recesses 24*a*, 24*b* further comprise a tapered portion 26, which is more or less extended depending on the recesses 24*a*, 24*b*, of which the axis of symmetry E2 intersects with the axis of symmetry E of the recess 24*a*, 24*b* and therefore with the axis of symmetry E1 of the spherical portion 25.

Figure 4:
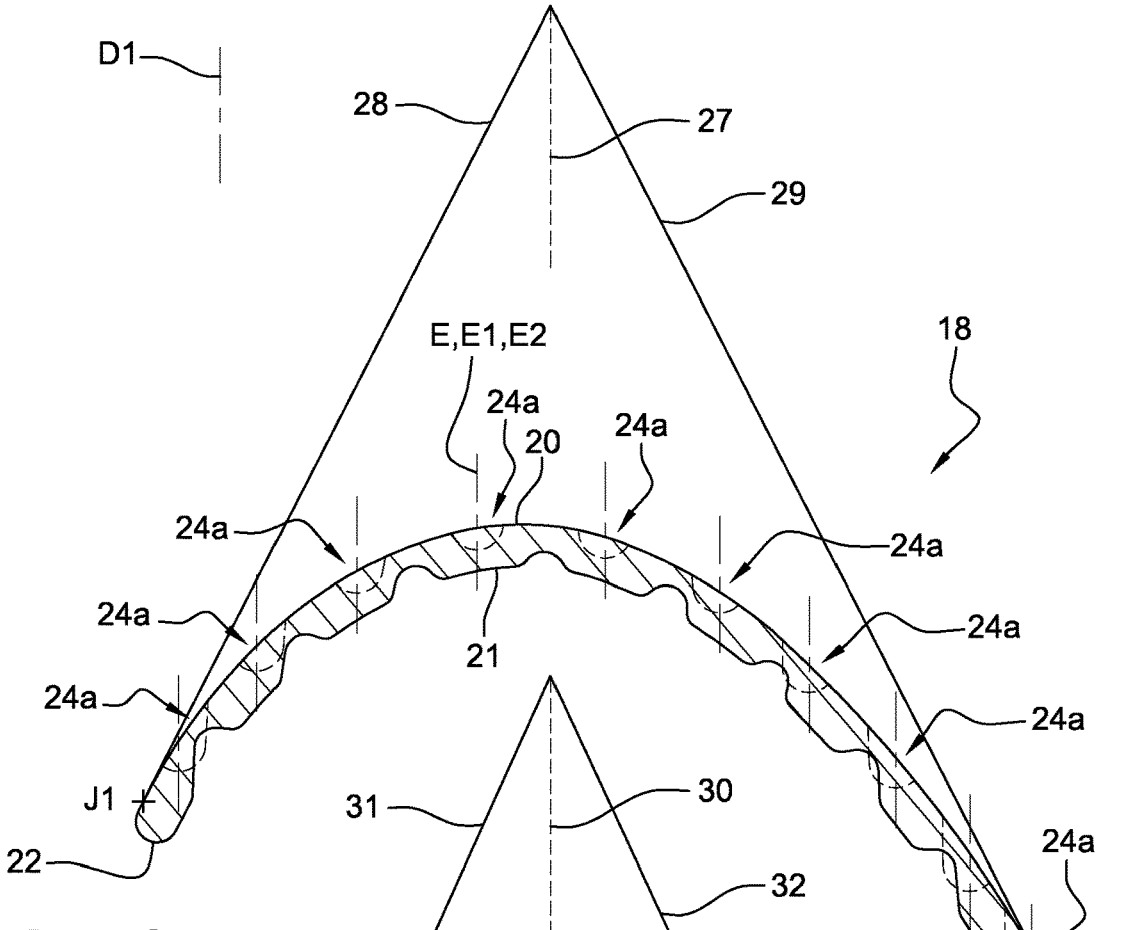
FIG. 4 is a simplified transversal cross-sectional view of the core, showing the determination of the direction of the recesses of a first face of the core, at the level of a leading portion.
Figure 5:
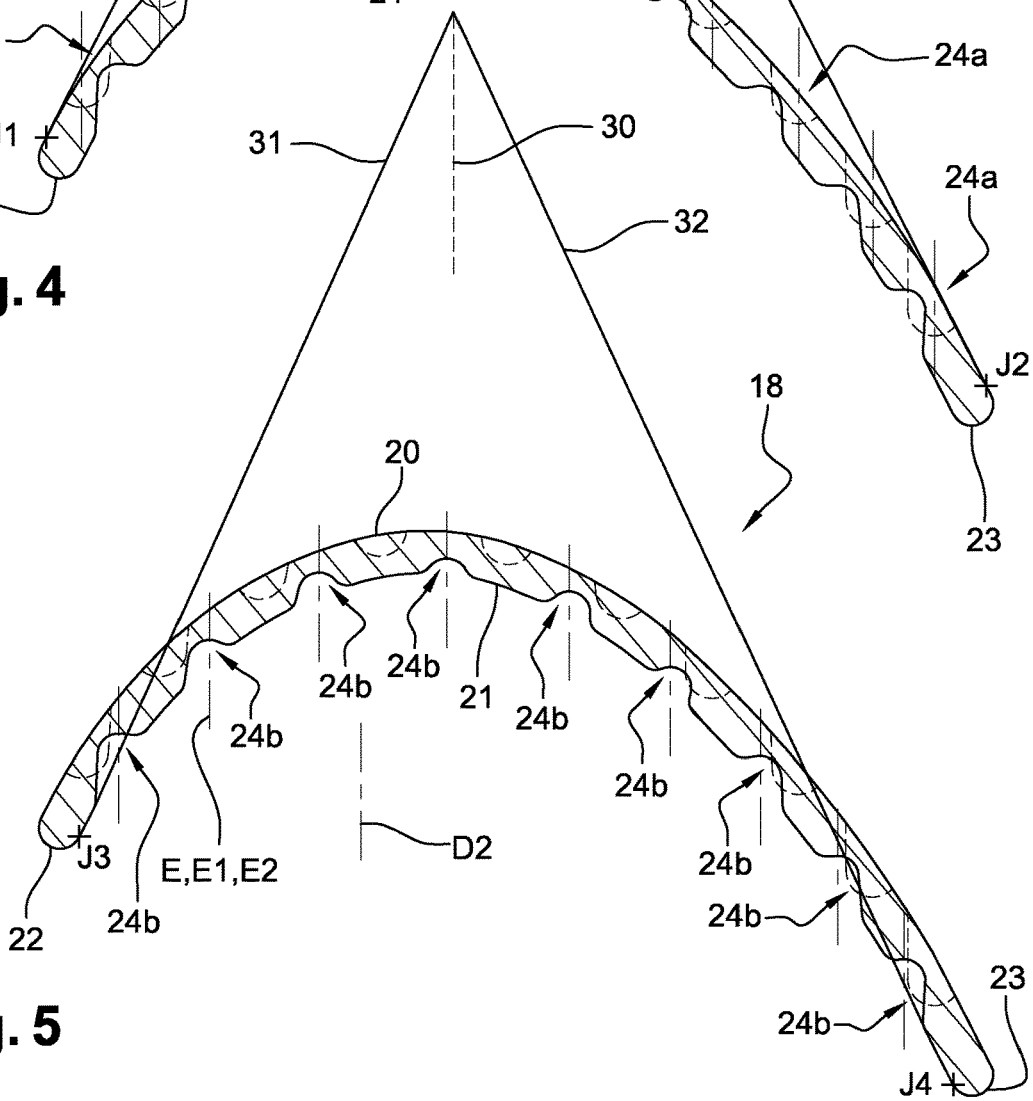
FIG. 5 is a simplified transversal cross-sectional view of the core, showing the determination of the direction of the recesses of a second face of the core, at the level of a leading portion.

Advantageously, such as shown in FIG. 4, the first direction D1 is defined, in a transversal plane, by the bisector 27 of the angle formed by the intersection of a first tangent 28 to the first face 20 at the first junction point J1 between the first face 20 and the first connection 22, and a second tangent 29 to the first face 20 at the second junction point J2 between the first face 20 and the second connection 23, the first and second tangents 28, 29 being defined in a transversal plane Advantageously, such as shown in FIG. 5, similarly to the first direction D1, the second direction D2 is defined, in a transversal plane, by the bisector 30 of the angle formed by the intersection of a first tangent 31 to the second face 21 at the third junction point J3 between the second face 21 and the first connection 22, and a second tangent 32 to the second face 21 at the fourth junction point J4 between the second face 21 and the second connection 23, the first and second tangents 31, 32 being defined in a transversal plane Advantageously, to avoid sharp edges, the recesses 24*a*, 24*b* comprise fillets (not shown).

According to the embodiment shown in the figures, the thickness of the core 18 is constant, the first and second directions D1, D2 therefore being parallel to one another. The thickness of the core 18 ranges, for example from 0.2 mm to 1 mm. The maximum depth of the recesses 24*a*, 24*b* is for example equal to half the thickness of the core 18.

Figure 6:
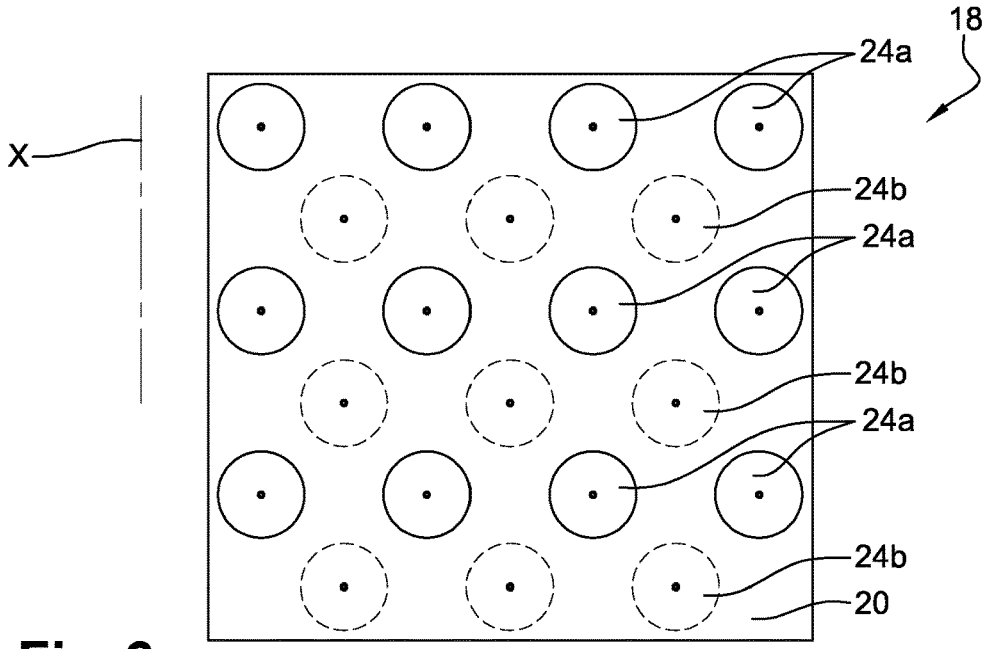
FIG. 6 is a detailed view of the core showing the location of the recesses.

FIG. 6 shows, in a plane perpendicular to the first direction D1 (or to the second direction D2), the location of the recesses 24*a* of the first face 20 with respect to the recesses 24*b* of the second face 21. As mentioned for the cavity 10 of the blade 1, advantageously, the recesses 24*a* of the first face 20 are offset, longitudinally and transversally, with respect to the recesses 24*b* of the second face 21. The recesses 24*a* are positioned substantially in a quincunx with respect to the recesses 24*b*. The radius of the spherical portions 25 ranges for example from 0.2 mm to 0.5 mm.

Generally, the recesses 24*a* must not come into contact with and/or open onto the recesses 24*b*, and a minimum material thickness must be provided between the recesses 24*a* and 24*b*. All connections between the bosses 15*a* and 15*b* are thereby avoided.

The shown example is in no way limiting. Indeed, the core 18 can comprise recesses 24*a*, 24*b* throughout the first and second faces 20, 21 or locally on the faces 20, 21.

According to an embodiment (not shown), the core 18 comprises recesses 24*a*, 24*b* only on the faces 20, 21 at the level of a second connection 23 (for example, one or more rows of recesses 24*a*, 24*b*). In this embodiment, the cooling cavity 10 comprises bosses 15*a*, 15*b* only on the walls 13, 14 at the level of the trailing edge 6.

Figure 7:
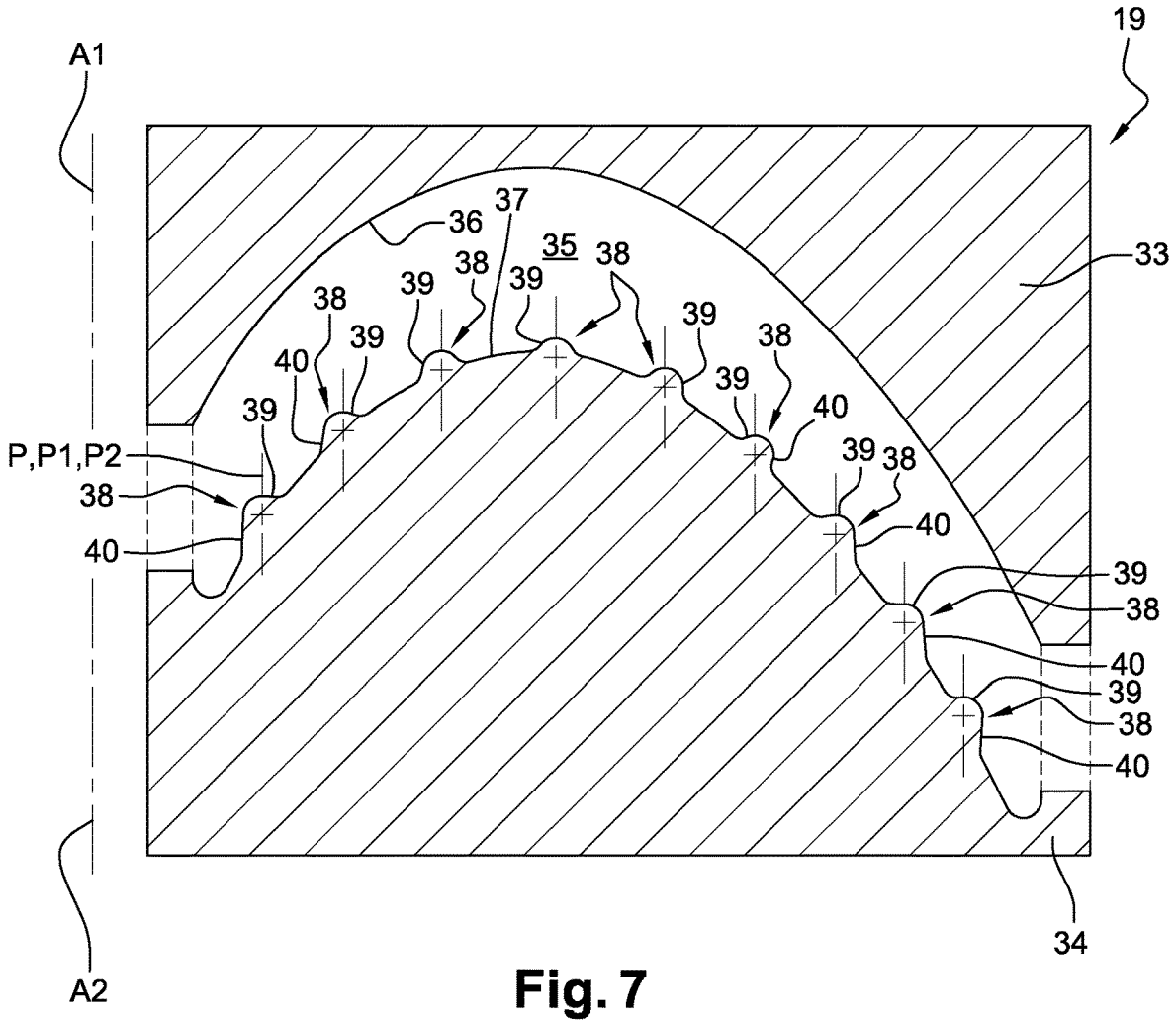
FIG. 7 is a section view of a mould capable of manufacturing the core.

The core 18 is obtained in the mould 19, shown in an open position in FIG. 7, the mould 19 comprising a first imprint 33 and a second imprint 34 that are mobile with respect to one another and delimit an injection cavity 35 of the core 18. The first imprint 33 comprises a first inner curved concave surface 36 configured to form the first face 20 of the core 18. The second imprint 34 comprises a second inner curved convex surface 37 configured to form the second face 21 of the core 18, the first and second surfaces 36, 37 comprising a plurality of protrusions 38 configured to form recesses 24*a*, 24*b* of the core 18.

Similarly as for the core 18, each protrusion 38 comprises a spherical part 39 and is defined at least partially according to an axis of symmetry P intersecting with the axis of symmetry P1 of the spherical portion 39. The axes of symmetry P1 of the spherical parts 39 of the first surface 36 are parallel with a first mould-release direction A1 corresponding with a first direction D1 of the core 18. Similarly, the axes of symmetry P1 of the spherical parts 39 of the second surface 37 are parallel with a second mould-release direction A2 corresponding to a second direction D2 of the core 18.

The fact that the first and second directions D1, D2 of the core 18 correspond to the first and second mould-release directions A1, A2 of the mould 19 makes it possible to simplify the structure of the mould 19 and to facilitate the extraction of the core 18 from the mould 19.

Similarly as for the core 18, certain protrusions 38 further comprise a tapered part 40, more or less extended depending on the protrusions 38, of which the axis of symmetry P2 intersects with the axis of symmetry P of the protrusion 38 and therefore with the axis of symmetry P1 of the spherical part 39.

The use of a tapered shape facilitates the extraction of the core 18 from the mould 19. The half-angle at the top of the tapered part 40 of the protrusions 38 is for example of 15°.

According to the embodiment shown in the figures, and in particular in FIG. 7, the first imprint 33 is mobile along the first mould-release direction A1 and the second imprint 34 is fixed.

According to a first embodiment alternative, the second imprint 34 is mobile along the second mould-release direction A2 and the first imprint 33 is fixed.

According to a second embodiment alternative, the first imprint 33 is mobile along the first mould-release direction A1 and the second imprint 34 is mobile along the second mould-release direction A2.

The core 18 is for example made of a ceramic material with a porous structure, this material being obtained from a mixture comprising a refractory filler and an organic fraction forming a binder.

More specifically, the manufacturing method of the core 18 in the mould 19 comprises the following steps:

- a step whereby the core 18 is moulded (shown in FIG. 3) in the mould 19 (shown in FIG. 7);
- A mould-release step wherein the first imprint 33 is moved along a first mould-release direction A1 and/or the second imprint 34 is moved along a second mould-release direction A2.
- a debinding step wherein the binder is eliminated, for example by thermal sublimation or thermal degradation;
- a thermal treatment step;
- a deburring step.

The invention claimed is:

1. A core configured for manufacturing a turbine engine blade by lost-wax casting, the core comprising:

- a first convex curved outer face having a plurality of recesses, each recess comprising a spherical portion; and
- a second concave curved outer face having a plurality of recesses, each recess comprising a spherical portion,
- wherein each recess of each face is defined at least partially by an axis of symmetry, the axes of symmetry of the spherical portions of the first face being parallel to a first direction defined, in a transversal plane, by the bisector of the angle formed by the intersection of:
  - a first tangent to the first face at a first point of junction between the first face and a first connection between the first and second faces; and
  - a second tangent to the first face at a second point of a junction between the first face and a second connection between the first and second faces,
- wherein the first and second tangents are defined in the transversal plane, and wherein the first and second points of junction are opposite one another.

2. The core of claim 1, wherein the recesses of the first face are offset with respect to the recesses of the second face.

3. The core of claim 1, wherein the axes of symmetry of the spherical portions of the second face are parallel with a second direction.

4. The core of claim 3, wherein the second direction is defined, in a transversal plane, by the bisector of the angle formed by the intersection of:

- a first tangent to the second face at a third point of junction between the second face and the first connection; and
- a second tangent to the second face at a fourth point of junction between the second face and the second connection,
- wherein the first and second tangents are defined in the transversal plane, and wherein the third and fourth points of junction are opposite one another.

5. A mold configured for the manufacturing of a core according to claim 1, the mold comprising:

- a first imprint; and
- a second imprint mobile with respect to the first imprint, the first and second imprints delimiting an injection cavity of the core, the first imprint comprising a first concave curved inner surface configured to form the first face of the core, the second imprint comprising a second convex curved inner surface configured to form the second face of the core, the first and second surfaces comprising a plurality of protrusions configured to form the recesses of the core, each protrusion comprising a spherical part,
- wherein each protrusion is defined at least partially by an axis of symmetry, the axes of symmetry of the spherical parts of the first surface defining the first direction of the core, the first direction parallel to the axes of symmetry of the spherical parts of the first surface and corresponding to a first mold-release direction.

6. The mold of claim 5, wherein the axes of symmetry of the spherical part of the protrusions of the second surface are parallel to a second direction of said core, the second direction corresponding to a second mold-release direction.

7. A method for manufacturing a blade of a turbine engine by lost-wax casting, the method comprising manufacturing a core in a mold according to claim 6; and moving one or more of the first imprint along the first mold-release direction and the second imprint along the second mold-release direction.

8. The mold of claim 6, wherein the second direction is defined, in a transversal plane, by the bisector of the angle formed by the intersection of:

a first tangent to a second face of the core at a third point of junction between the second face and a first connection between the second face and a first face; and a second tangent to the second face at a fourth point of junction between the second face and a second connection between the first and second faces, wherein the first and second tangents are defined in the transversal plane, and wherein the third and fourth points of junction are opposite one another.

9. A blade comprising:

a cooling cavity delimited by a first concave curved inner wall having a plurality of bosses, each boss comprising a spherical section, and a second convex curved inner wall having a plurality of bosses, each boss comprising a spherical section, wherein each boss of each wall is defined at least partially by an axis of symmetry, the axes of symmetry of the spherical sections of the first wall being parallel to a first direction defined, in a transversal plane, by the bisector of the angle formed by the intersection of:

a first tangent to the first wall at a first point of junction between the first wall and a first connection between the first and second walls; and a second tangent to the first wall at a second point of junction between the first wall and a second connection between the first and second walls, wherein the first and second tangents are defined in the transversal plane, and wherein the first and second points of junction are opposite one another.

10. The blade of claim 9, wherein the axes of symmetry of the spherical sections of the second wall are parallel with a second direction.

11. The blade of claim 10, wherein the second direction is defined, in a transversal plane, by the bisector of the angle formed by the intersection of:

a first tangent to the second wall at a third point of junction between the second wall and the first connection; and a second tangent to the second wall at a fourth point of junction between the second wall and the second connection, wherein the first and second tangents are defined in the transversal plane, and wherein the third and fourth points of junction are opposite one another.

* * * * *